US009332826B2

(12) United States Patent
Spillman, Jr.

(10) Patent No.: US 9,332,826 B2
(45) Date of Patent: May 10, 2016

(54) CLEANING DEVICE

(71) Applicant: Ricky Spillman, Jr., Tempe, AZ (US)

(72) Inventor: Ricky Spillman, Jr., Tempe, AZ (US)

(73) Assignee: Ricky Spillman, Jr., Los Gatos, CA (US)

( * ) Notice: Subject to any disclaimer, the term of this patent is extended or adjusted under 35 U.S.C. 154(b) by 0 days.

(21) Appl. No.: 14/327,056

(22) Filed: Jul. 9, 2014

(65) Prior Publication Data

US 2016/0007726 A1 Jan. 14, 2016

(51) Int. Cl.
*A46B 9/02* (2006.01)

(52) U.S. Cl.
CPC ..... *A46B 9/02* (2013.01)

(58) Field of Classification Search
CPC ..... A46B 9/026; A46B 1/00; A46B 9/028; A46B 2200/3013; A46B 9/02; E03B 9/18; A63B 47/04; A45D 40/04
See application file for complete search history.

(56) References Cited

U.S. PATENT DOCUMENTS

| | | | | |
|---|---|---|---|---|
| 3,188,674 | A | 6/1965 | Hobbs | |
| 3,362,776 | A | 1/1968 | Knorr | |
| 4,137,929 | A | 2/1979 | Grossman | |
| 4,564,968 | A * | 1/1986 | Buckley | 15/21.1 |
| 4,819,672 | A * | 4/1989 | Walker et al. | 132/75 |
| 5,048,547 | A * | 9/1991 | Walker | 132/75 |
| 5,298,077 | A * | 3/1994 | Saarela et al. | 134/6 |
| 5,810,021 | A * | 9/1998 | Walker | 132/74.5 |
| 6,116,248 | A * | 9/2000 | Walker | 132/74.5 |
| 6,314,965 | B1 * | 11/2001 | Walker | 132/74.5 |
| 6,647,549 | B2 | 11/2003 | McDevitt et al. | |
| 6,692,118 | B2 | 2/2004 | Michele et al. | |
| 6,813,798 | B2 * | 11/2004 | Moga | 15/104.93 |
| 7,507,047 | B2 | 3/2009 | Oberstadt et al. | |
| 7,857,793 | B2 * | 12/2010 | Raulerson et al. | 604/267 |
| 7,918,233 | B2 * | 4/2011 | Burgess et al. | 132/75.6 |
| 8,893,735 | B2 * | 11/2014 | Shatz | 134/184 |
| 2009/0235470 | A1 * | 9/2009 | Moisides | 15/21.1 |
| 2014/0326193 | A1 * | 11/2014 | Plummer | A01J 7/04 119/651 |

FOREIGN PATENT DOCUMENTS

| | | |
|---|---|---|
| EP | 0380182 | 11/1993 |
| EP | 0698423 | 1/1999 |

(Continued)

OTHER PUBLICATIONS

"Rotational Finger Brush," Dent Fix Equipment, 2015 [retrieved on Mar. 17, 2016]. Retrieved from the Internet: URL<http://dentfix888.com/?product=rotational-finger-brush>, 4 pages.

(Continued)

*Primary Examiner* — Dung Van Nguyen
(74) *Attorney, Agent, or Firm* — Fish & Richardson P.C.

(57) ABSTRACT

A cleaning device comprises a body that defines an opening. The device includes a fluid reservoir disposed within the body, an outlet in fluid communication with the fluid reservoir, and a plurality of flexible elements disposed about the perimeter of the opening and projecting inwardly. In some embodiments, the outlet is located on an inner perimeter of the device, where the inner perimeter defines the opening. In some embodiments, the outlet is located on an outer perimeter of the device. The device may include a compressible member in fluid communication with the fluid reservoir and the outlet. In some embodiments, the plurality of flexible elements, or protrusions, include ribbing or ridges.

18 Claims, 10 Drawing Sheets

(56) References Cited

FOREIGN PATENT DOCUMENTS

| | | |
|---|---|---|
| EP | 1827560 | 9/2007 |
| WO | 2006/071300 | 7/2006 |

OTHER PUBLICATIONS

Young, "The Kiba Design H2Go Replaces Plastic Bottles," Trend Hunter, Mar. 17, 2010 [retrieved on Mar. 17, 2016]. Retrieved from the Internet: URL<http://ww.trendhunter.com/trends.kiba-design-h2go>, 10 pages.

* cited by examiner

CLEANING DEVICE

TECHNICAL FIELD

This document relates generally to a cleaning device, and more specifically, to a device for cleaning fingers.

BACKGROUND

In many daily activities, people's hands inevitably get dirty with bacteria, dirt, tar, oil, or other substances. For example, tar may build up on a cigarette smoker's hands, or a mechanic may struggle to remove grease residue from working on cars from his hands. In another example, a gardener may find her hands muddy after digging in dirt, planting flowers, and tending to shrubs.

Common methods of cleaning one's hands, such as handwashing, can be effective at removing unwanted substances. Unfortunately, hand washing with soap and water is not always an option or may not be convenient. There may be no sink nearby. Or constant hand washing can cause the skin to become dry and cracked. Hand sanitizer is an alternative to hand washing and can help to kill most bacteria and stop some viruses. However, hand sanitizer does not always remove certain substances, such as tar or dirt build up from the fingers. It may also be ineffective to remove or mask unwanted odors. Furthermore, commercial soaps alone are not always effective to remove some substances and certain odors from fingers. Soap also requires the use of water and a drying material, such as a towel, which may not always be readily available.

SUMMARY

This document describes various embodiments of a device for cleaning fingers. The device is small (e.g., small enough to fit in most pockets) with an opening such that a finger can comfortably fit through an opening. Within the opening is a plurality of protruding elements (e.g., bristles) that help to scrub the fingers and remove unwanted substances. The device itself may also be substantially hollow so that it can further hold a fluid that assists in cleaning the fingers. This fluid may be released or poured from the device through an opening in the exterior of the device or from one or more openings in the interior of the device (e.g., along the opening through which a user can fit his finger). If the device releases the fluid through an opening in the exterior of the device, the device itself may serve the function of a bottle with a cap or other means for preventing unwanted spills. If the device releases the fluid through an inner perimeter of the device, which defines the central opening of the device through which a user places his finger for cleaning, the fluid may, for example, be extruded or expelled from the device on or near the plurality of protruding elements to aid in removing unwanted substances from the fingers.

In some embodiments, the opening may be circular (i.e., ring-shaped) to fit around an adult's finger. The plurality of protrusions extend from the inner perimeter of the opening so that when a person puts his finger through the opening, the plurality of protrusions can make contact with the finger to effectively scrub away debris or other substances on the person's finger. In this manner, a user can clean his finger by repeatedly placing his finger through the opening, and moving his finger back and forth or with a circular motion within the motion, so that the protrusions scrub unwanted materials from the finger.

In some implementation, the device includes a body defining a centrally-located opening. The body may include a fluid reservoir within the body, an outlet in fluid communication with the fluid reservoir, and a plurality of flexible elements disposed about the perimeter of the opening and projecting inwardly.

The body may further include a compressible member in fluid communication with the fluid reservoir and the outlet. In some implementations, the compressible member can be compressed to release a portion of fluid located in the fluid reservoir. In some implementations, the fluid is released by way of the outlet. In some implementations, the fluid is directed to one or more of the plurality of flexible elements. The plurality of flexible elements may be disposed around an entirety of the perimeter of the opening. In some implementations, the plurality of flexible elements is disposed around only a portion of the perimeter of the opening. In some implementations, a plurality of corrugated protrusions is located along at least a portion of the plurality of flexible elements.

In some implementations, an entirety of an interior of the body comprises the fluid reservoir. The body may comprise a plurality of sections releasably coupled together. The plurality of sections may be releasably coupled together using either a snap fit arrangement or a threaded arrangement. In some implementations, the body comprises an outer perimeter and an inner perimeter that defines the opening, wherein the outer perimeter comprises a plurality of protrusions. In some implementations, the body is substantially donut-shaped.

In some implementation, the device includes a disk-shaped body. The disk-shaped body may include an outer perimeter, an inner perimeter defining an opening, a fluid reservoir disposed within the body, an outlet in fluid communication with the fluid reservoir, and a plurality of flexible elements extending from the inner perimeter, each of the plurality of flexible elements having a first end and a second end. The disk-shaped body may further include a compressible member in fluid communication with the fluid reservoir and the outlet. The compressible member may be compressed to release a portion of fluid located in the fluid reservoir. In some implementations, the outlet is located on the outer perimeter of the disk-shaped body, and the disk-shaped body includes a closure for opening and closing the outlet. In some implementations, the closure includes a snap-fit cap.

In some implementations, the plurality of flexible elements is disposed around an entirety of the perimeter of the opening. In some implementations, the disk-shaped body includes a compressible member disposed on the inner perimeter of the disk-shaped body in fluid communication with the fluid reservoir and the outlet, wherein the compressible member can be compressed to release a portion of fluid located in the fluid reservoir, wherein the outlet is disposed on the inner perimeter of the disk-shaped body that defines the opening.

Other features and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
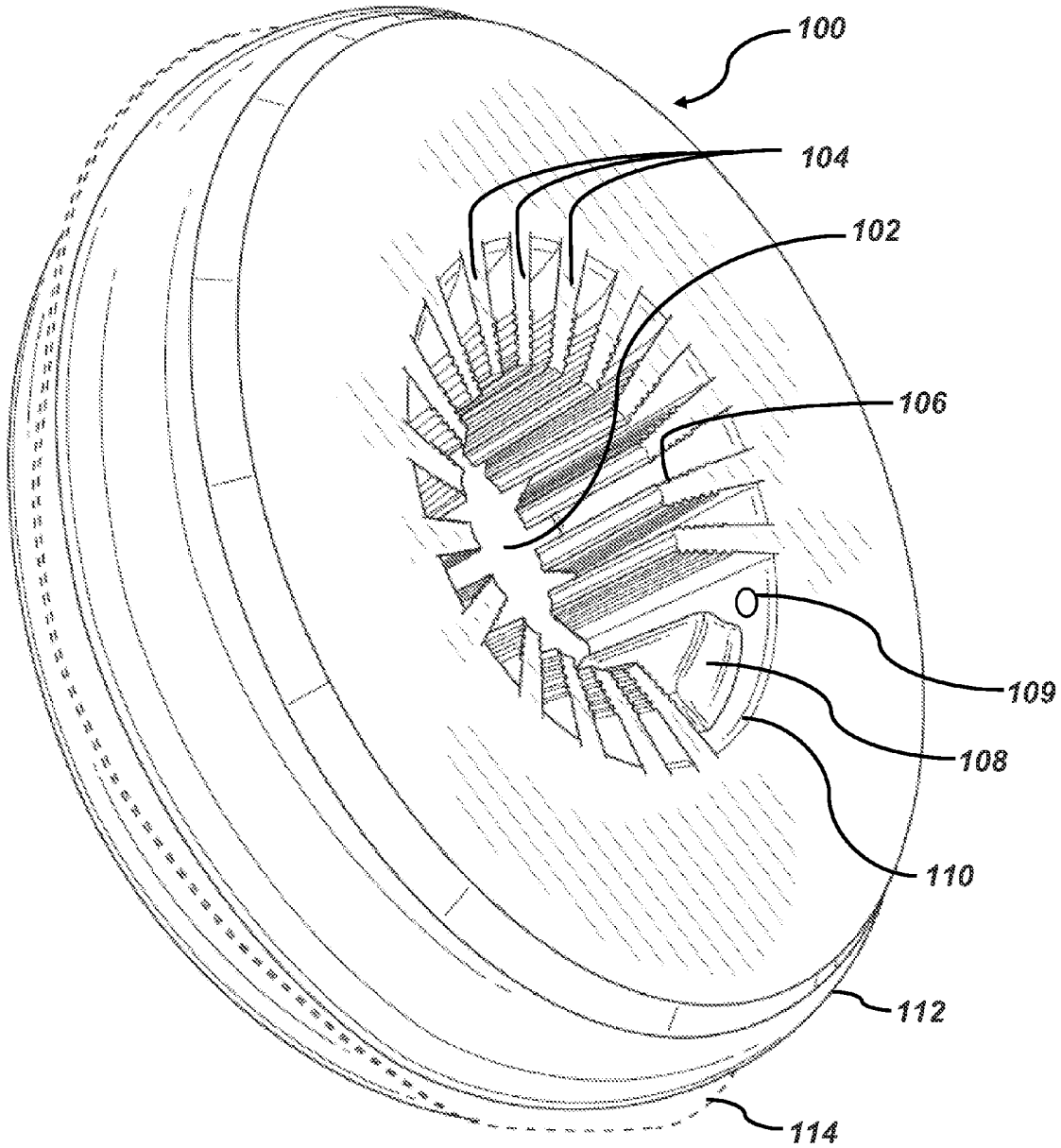
FIG. 1 is a front (and rear) perspective view of the cleaning device according to a first embodiment.
Figure 2:
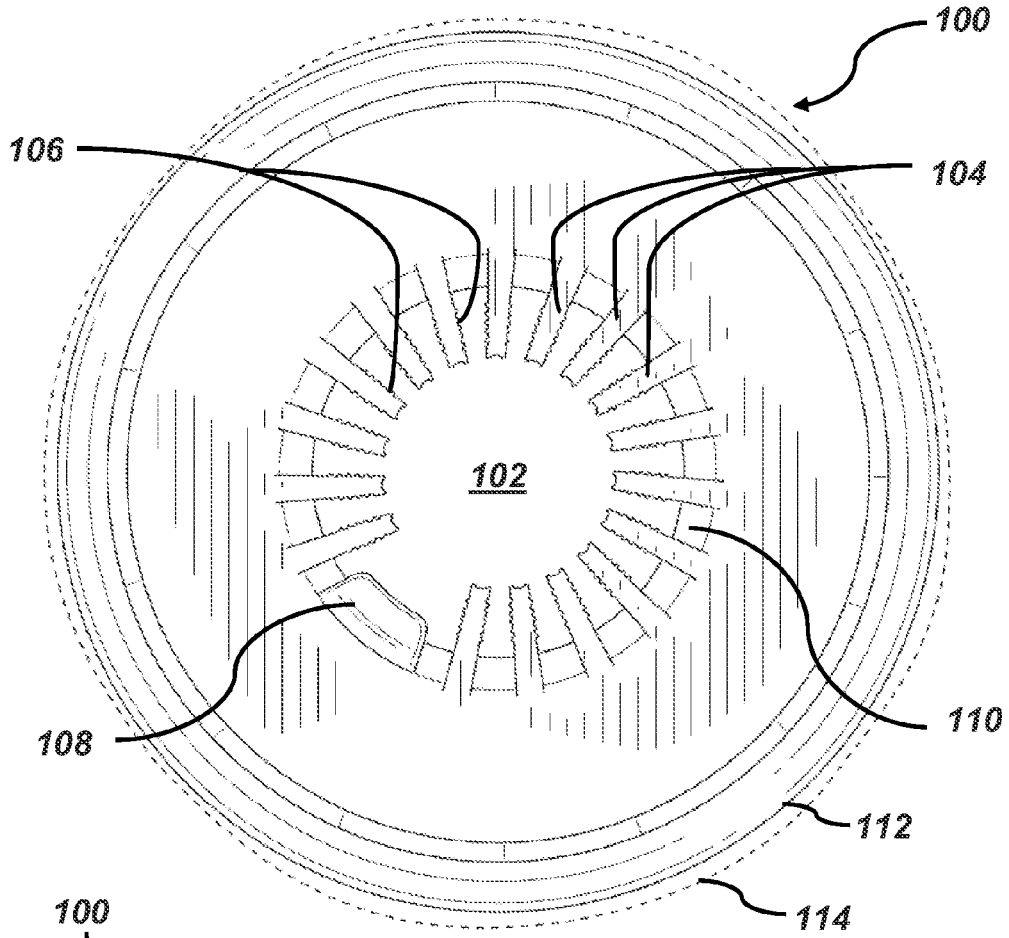
FIG. 2 is a front (and rear) elevation view of the cleaning device according to the first embodiment.
Figure 3:
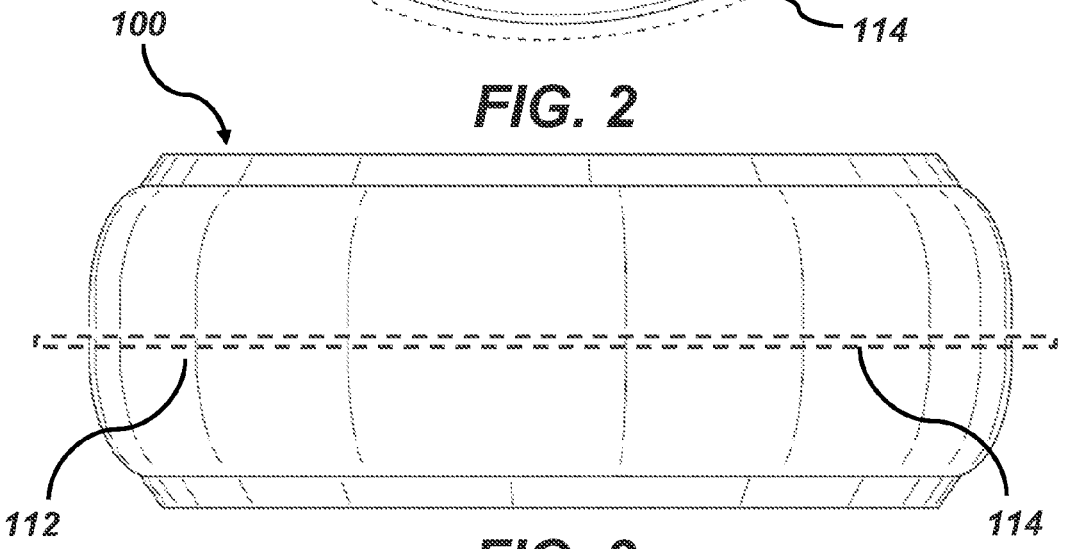
FIG. 3 is a side elevation view of the cleaning device according to the first embodiment.

FIG. 1 depicts a cleaning device 100 according to a first embodiment. The device 100 defines an opening 102 located in the center of the device 100. In some embodiments, the device 100 is substantially donut-shaped, but the opening 102 could be located off-center in alternative embodiments. The device 100 may be substantially hollow. A plurality of flexible elements 104 (e.g., bristles) 104, or protrusions, extend from the inner perimeter 110 of the device 100 toward the center of the opening 102, where the inner perimeter 110 defines the opening 102. A compressible member (e.g., a button) 108 may be located on the inner perimeter 110 of the device 100. The compressible member 108 is in fluid communication with a fluid reservoir and an outlet 109. The fluid reservoir (not shown) may be located in the interior hollow portion of the device 100.

One or more of the plurality of protrusions 104 has a first end and a second end, where one of the ends is affixed to or extends from the inner perimeter 110 of the device and one of the ends extends toward and terminates near the center of the opening 102. In some embodiments, one or more of the plurality of protrusions 104 may further include ribbing 106, or corrugated protrusions, along at least a portion of the flexible protrusions 104. The ribbing 106 may be present around the entirety of each of the protrusions 104 or only in some locations. As shown in FIG. 1, ribbing 106 may be present near the ends of the protrusions closest to the center of the opening 102. Such a configuration is helpful in use because the ribbing 106 causes an extra scrubbing effect when contacting a person's finger. The ribbing 106 may comprise a number of small uniformly-sized ridges along the protrusion, as shown in FIG. 1, or the ribbing may comprises ridges or other projections of differing shapes and sizes. Ribbing 106 may be present only along the sides of the protrusions 104 or only on the ends of the protrusions 104 closest to the center of the opening 102. In some embodiments, ribbing 106 may be present on both the sides and the ends of the protrusions 104. In some embodiments, ribbing 106 is present along the entire exterior of the one or more protrusions 104.

The device 100 includes a compressible member (e.g., a button) 108 located on the inner perimeter 110 of the device 100. As shown in FIG. 1, the inner perimeter 110 of the device 100 may include a plurality of protrusions 104 around nearly the entirety of the inner perimeter 110 where the compressible member 108 is located in the only substantial portion of the inner perimeter 110 without protrusions 104. The compressible member 108 is in fluid communication with the outlet 109 and a fluid reservoir (not shown). When the compressible member 108 is pushed, fluid, such as hand soap, stored in the fluid reservoir is caused to be released from the outlet 109 of the device 100. The outlet 109 may be located in the inner perimeter 110 of the device 100, for example, between two of the protrusions 104. In some embodiments, more than one outlet 109 is present. In some embodiments, the outlet 109 is located on the compressible member 108, wherein compressing the compressible member 108 causes the outlet 109 to open. In some embodiments, one or more outlets 109 are located adjacent to one or more of the protrusions 104.

In some embodiments, the protrusions 104 are disposed around an entirety of the inner perimeter 110 of the opening 102. In these embodiments, the compressible member 108 may be located on the exterior perimeter 112 of the device 100 or on one of the two circular faces of the device 100. If the compressible member 108 is not located within the inner perimeter 110 of the device 100, it is preferable to use a stiffer material for the compressible member 108 so that the compressible member 108 is not inadvertently compressed when being transported in a pocket or a purse. Alternatively, a different method could be employed for releasing the fluid from the fluid reservoir where a compressible member 108 is not located along the inner perimeter 110 of the device. For example, the device 100 may comprise an outlet 109 with a closure, similar to the closure described below with respect to the third embodiment shown in FIG. 7.

In some embodiments, the compressible member 108 requires a substantial force to compress to avoid accidental and unintentional release of fluid from the fluid reservoir. In some embodiments, the outlet 109 may be located on the compressible member 108 so that compression of the compressible member 108 causes the outlet 109 to open. For example, the outlet 109 may comprise a slit in the compressible member 108 that does not allow fluid to escape the device 100 when the compressible member 108 is not compressed (i.e., because the tension in the material prevents unwanted leakage of fluid). However, when the compressible member 108 is pressed, movement of the compressible member 108 material (e.g., bending of the material) causes the slit to open and allow fluid from the fluid reservoir to be released. In a preferred embodiment, the slit is formed using a rubber material having adequate tension to prevent leakage of fluid when the compressible member 108 is not compressed. In a preferred embodiment, the fluid comprises a viscous fluid (e.g., a gel) to further prevent against unwanted leakage.

The device 100 may comprise two symmetrical halves 122, 124 that are releasably coupled together along an outer perimeter of device 120. In some embodiments, the two halves 122, 124 are coupled together using a snap fit arrangement. In other embodiments, the two halves 122, 124 are coupled together using a threaded arrangement. In other embodiments, the device 100 may comprise more than two separate parts to assemble.

In some embodiments, the fluid reservoir may comprise a fluid pack. In one embodiment, the fluid pack can be "captured" in the device 100 by the two halves 122, 124 such that the outer perimeter of the fluid pack 114 is optionally visible outside the device 100. By capturing the fluid pack in this manner so that the outer perimeter 114 is visible outside of the device 100, the fluid pack is effectively held in place by the two halves 122, 124. In some embodiments, the entirety of the hollow interior of the device 100 comprises the fluid reservoir.

In use, a person may use one hand to hold the device 100 while inserting an unclean finger through the opening 102 of the device 100. In a preferred embodiment, the diameter of the opening 102 is slightly larger than the average diameter of an adult human finger so that the person's finger makes contact with the plurality of protrusions 104 but not with the inner perimeter 110 of the device 100. Furthermore, because the opening is only slightly larger than the person's finger, the person's finger makes contact not only with the ends of the plurality of protrusions 104 closest to the center of the opening 102, but also with the sides of the plurality of protrusions 104. Where each of the protrusions 104 includes additional ribbing 106, the ribbing 106 also makes contact with the person's finger as the person moves his finger through the opening to create friction and scrub unwanted materials off the person's finger.

The person may further use either hand to push on the compressible member 108 to cause the device 100 to release fluid from the fluid reservoir located within the device 100. Pushing on the compressible member 108 causes one or more openings 109 to release fluid. The fluid may comprise any type of fluid that assists in removing unwanted materials or odors from the person's hand, such as, for example, hand soap, hand sanitizer, or any other liquid cleaning agent. When the person releases the compressible member 108, fluid no longer exits the device 100 through the one or more outlets 109. The outlet 109 is preferably located along the inner perimeter 110 of the device 100 so that the fluid is conveniently located on or near the plurality of protrusions 104 to help the process of removing unwanted materials or odors from the person's finger. In some embodiments, the fluid may be directed to one or more of the plurality of flexible protrusions 104. In some embodiments, the fluid is gel-like and viscous to minimize unwanted dripping or leaking from the device. The greater the viscosity of the fluid, the more likely that the fluid will remain on the person's finger while scrubbing. In some embodiments, where the fluid is a hand-sanitizing fluid that includes alcohol, a person can press the compressible member 108 to release enough fluid to cover the surface of the finger and use the device 100 to scrub his finger to remove unwanted materials and odors until his finger is completely dry. Given the nature of hand sanitizing fluid, which generally includes alcohol, no towel is needed to dry the hands after the scrubbing is complete. This is beneficial in situations where towels are not readily available to clean up or dry any residual fluid.

In some embodiments, the exterior of the device 100 comprises a rubber material so that a person can hold the fluid-releasing device 100 with one hand while cleaning the other hand with minimal slipping.

Figure 4:
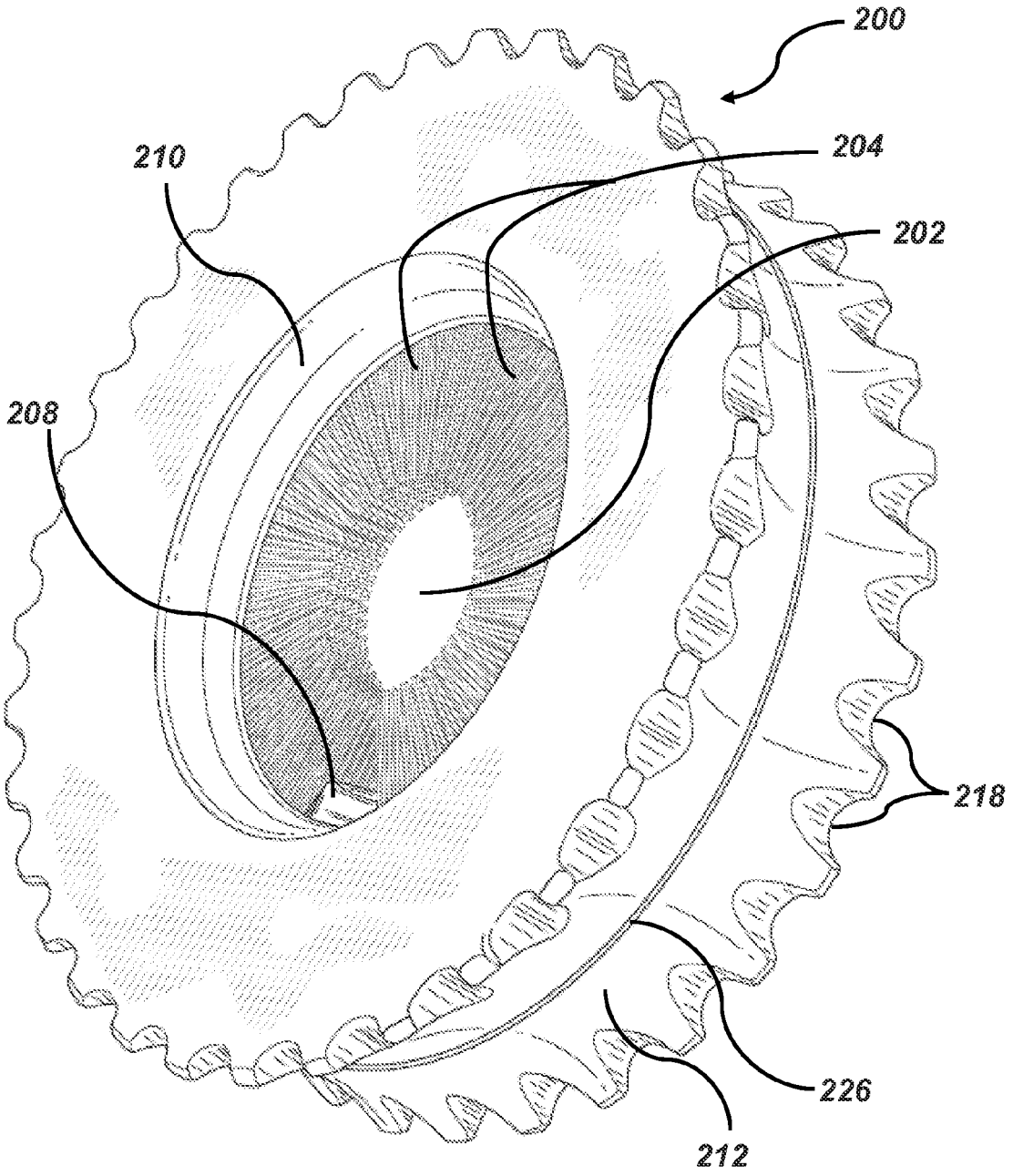
FIG. 4 is a front (and rear) perspective view of the cleaning device according to a second embodiment.

FIG. 4 depicts a cleaning device 200 according to a second embodiment. The device 200 defines an opening 202 located in the center of the device 200. Specifically, the opening 202 is defined by an inner perimeter 210 of the device 200. As with the first embodiment, the device 200 of the second embodiment may be substantially hollow for storing a cleaning fluid. A plurality of protrusions 204 extend from the inner perimeter 210 of the device 200 toward the center of the opening 202. Each of the plurality of protrusions 204 has a first end and a second end, where one of the ends is affixed to or extends from and terminates near the inner perimeter 210 of the device and one of the ends extends toward the center of the opening 202. The plurality of protrusions 204 may be bristles. The bristles may be textured to assist in the scrubbing process. A compressible member (e.g., a button) 208 is located on the inner perimeter 210 of the device 200. The compressible member 208 is in fluid communication with a fluid reservoir and an outlet (not shown). The fluid reservoir (not shown) may be contained within the device 200.

In some embodiments, the plurality of protrusions 204 are located on a bristle ring that can be inserted as a single piece into the inner perimeter 210 of the device 200 during assembly. In some embodiments, the bristle ring can be easily removed and replaced, as needed. This may be beneficial where the plurality of protrusions 204 become worn or too dirty to clean. The replaceable bristle ring also allows a user to replace only the bristle ring without having to buy a completely new device 200 when the plurality of protrusions 204 are dirty or require replacement but the reset of the device 200 is still in working order. The bristle ring may comprise a rubber material that can be pinched into place in the inner perimeter 210 of the device 200.

The device 200 may comprise two substantially symmetrical halves 222, 224 that connect along an outer perimeter 220 of device 200. The two halves 222, 224 can be separated to replace the fluid reservoir contained within the device 200. In some embodiments, the fluid reservoir comprises a fluid pack. In some embodiments, the fluid pack is C-shaped with one end comprising an outlet from which fluid is released from the fluid pack. In some embodiments, the interior of the device 200 comprises a roller operably connected with the compressible member 208. The roller may be located on the non-outlet end of the C-shape. The width of the roller is only slightly smaller than the width of the interior of the device 200, such that the roller is free to roll on a circular track formed by the interior of the device 200.

In use, when a user presses the compressible member 208, the roller is caused to advance on the circular track toward the outlet, which, in turn, causes fluid to be pushed out of the fluid pack through the outlet of the fluid pack. In some embodiments, the C-shaped fluid pack is substantially tubular when filled with fluid, but after the roller has rolled over the fluid pack becomes flattened, much like a tube of toothpaste that has been properly squeezed from the bottom to the top. The fluid pack may be replaced after it is emptied. In some embodiments, when the fluid pack is replaced, the position of the roller must also be reset back to the non-outlet end of the C-shape.

In some embodiments, the exterior perimeter 212 of the device 200 is not smooth (such as, for example, the first embodiment shown in FIG. 1) but rather includes a number of grooves 218. The grooves 218 can assist a user who is attempting to separate the two halves 222, 224 of the device where the two halves 222, 224 screw on and off, creating more friction between a user's hands and the device 200. In some embodiments, separate grooves are present on each half 222, 224 of the device 200, as shown in FIG. 4. The two halves 222, 224 connect along an exterior perimeter 226 of the device 200. In some embodiments, the circumference of each half 222, 224 is smaller near the exterior perimeter 226 (where the two halves 222, 224 connect) and larger near the outer edges 228, 230 of the device 200.

In use, a person may use one hand to hold the device 200 while inserting a finger through the opening 202 of the device 200. The grooves 218 located on the exterior edge 212 of the device 200 can aid a person holding the device 200 so that the device does not move or slip while in use. As with the first embodiment, in a preferred embodiment, the diameter of the opening 202 is slightly larger than the diameter of the person's finger so that the person's finger makes contact with the plurality of protrusions 204 but not with the inner perimeter 210 of the device 200. In use, this configuration—with the device 200 having a concave perimeter, as illustrated in FIG. 4—allows a person to easily grip the device 200 with one hand, for example, wrapping his thumb and index finger/middle finger around the circumference 212 of the device 200 with the concave perimeter conforming to the shape of his thumb and finger. When a person holds the device in this manner, the hand he is using to hold the device ("the holding hand"), it is less likely that any fingers from the holding hand" obstruct the opening because his fingers are encircling the device. This is beneficial when the user is cleaning fingers of his non-holding hand. Furthermore, when a person holds the device in this manner, the outer edges 228, 230 of the device 200 prevent a person's holding hand and fingers from slipping or moving in response to force from a finger moving in and out of the opening 202 and through the plurality of protrusions 202.

The person may use either hand to push on the compressible member 208 to cause the device 200 to release fluid from the fluid reservoir located within the device 200. Pushing on the compressible member 208 causes one or more openings to release fluid. As described above, the fluid reservoir may comprise a C-shape that releases fluid when a roller located in the interior of the device 200 advances. In such an embodiment, the device 200 may include a single outlet for releasing the liquid. The fluid may comprise any type of fluid that assists in removing unwanted materials or odors from the person's hand, such as, for example, hand soap, hand sanitizer, or any liquid cleaning agent. When the person releases the compressible member 208, fluid no longer exits the device 200. The outlet is preferably located on the inner perimeter 210 of the device 200 so that the fluid is conveniently located on or near the plurality of protrusions 204 to help the process of removing unwanted materials or odors from the person's finger. In some embodiments, the fluid may be directed to one or more of the plurality of flexible protrusions 204. In some embodiments, the fluid is a gel-like, viscous liquid to minimize unwanted dripping or leaking from the device. In some embodiments, where the fluid is a hand-sanitizing fluid that includes alcohol, a person can press the compressible member 210 to release enough fluid to cover the surface of the finger and use the device 200 to scrub his finger to remove unwanted materials and odors until his finger is completely dry. Given the nature of hand sanitizing fluid, which generally includes alcohol, no towel is needed to dry the hands after the scrubbing is complete because the fluid evaporates relatively quickly. This is beneficial in situations where towels are not readily available to clean or soak up any residual fluid.

Figure 7:
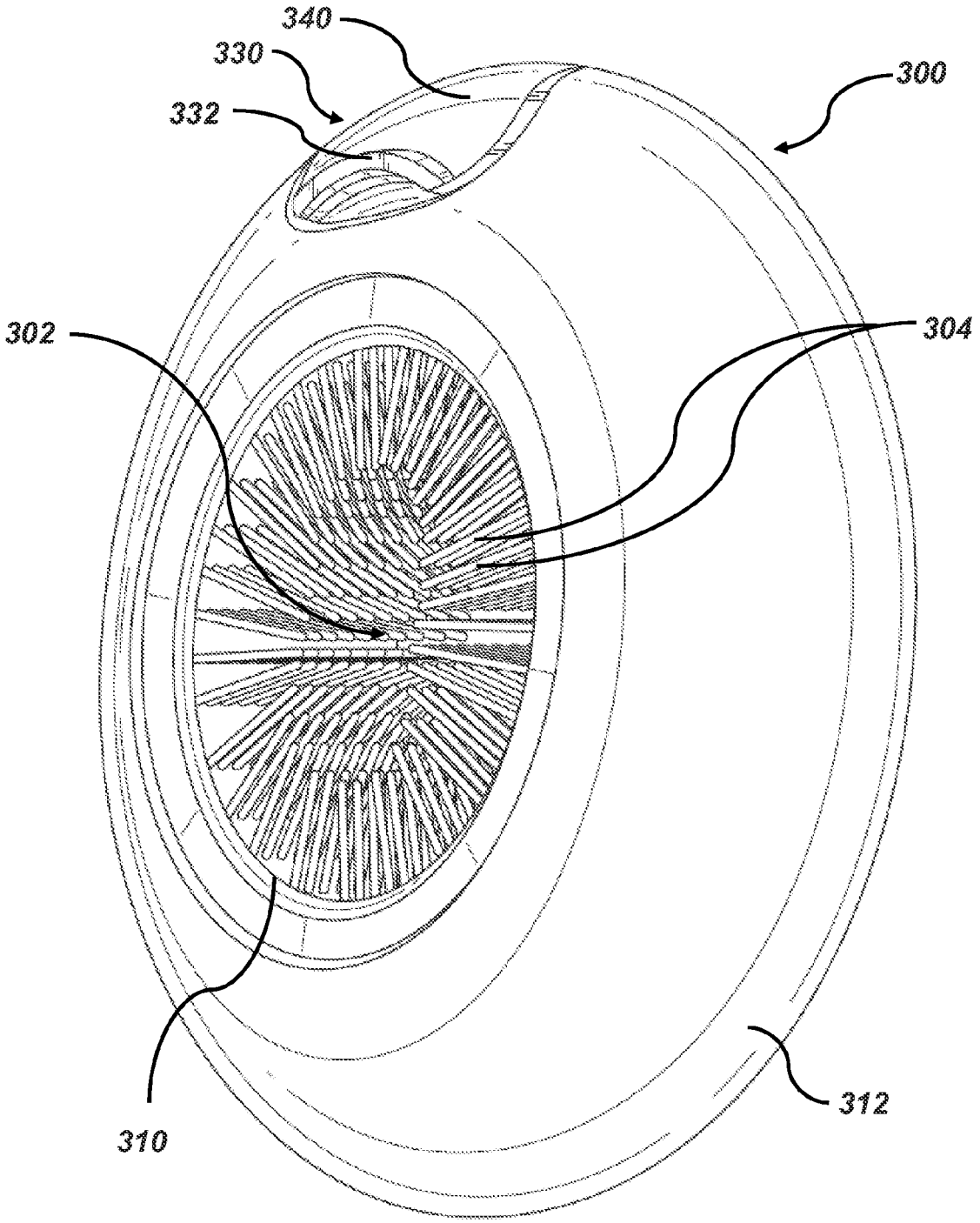
FIG. 7 is a front perspective view of the cleaning device according to a third embodiment.
Figure 8:
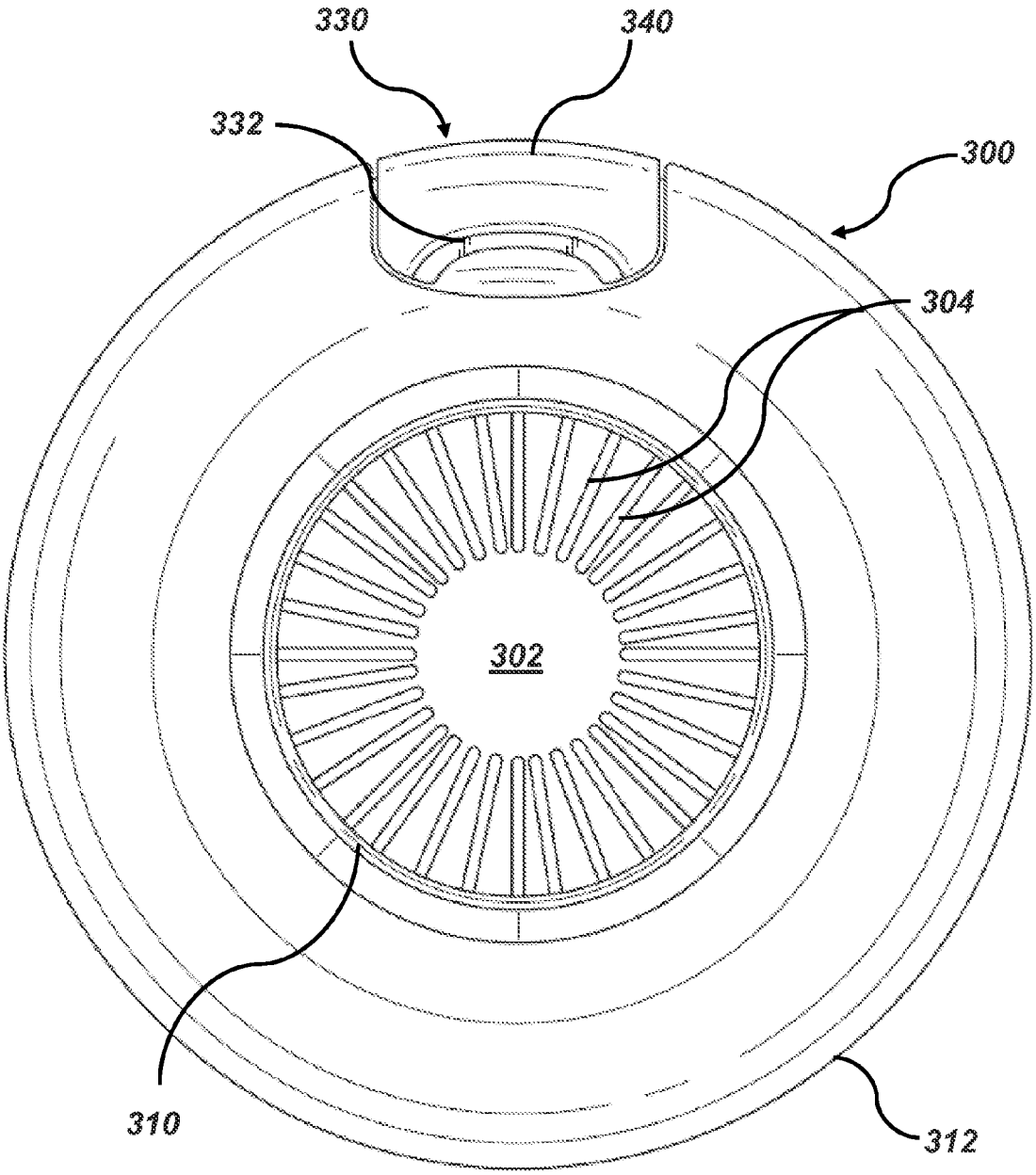
FIG. 8 is a front elevation view of the cleaning device according to the third embodiment.
Figure 9:
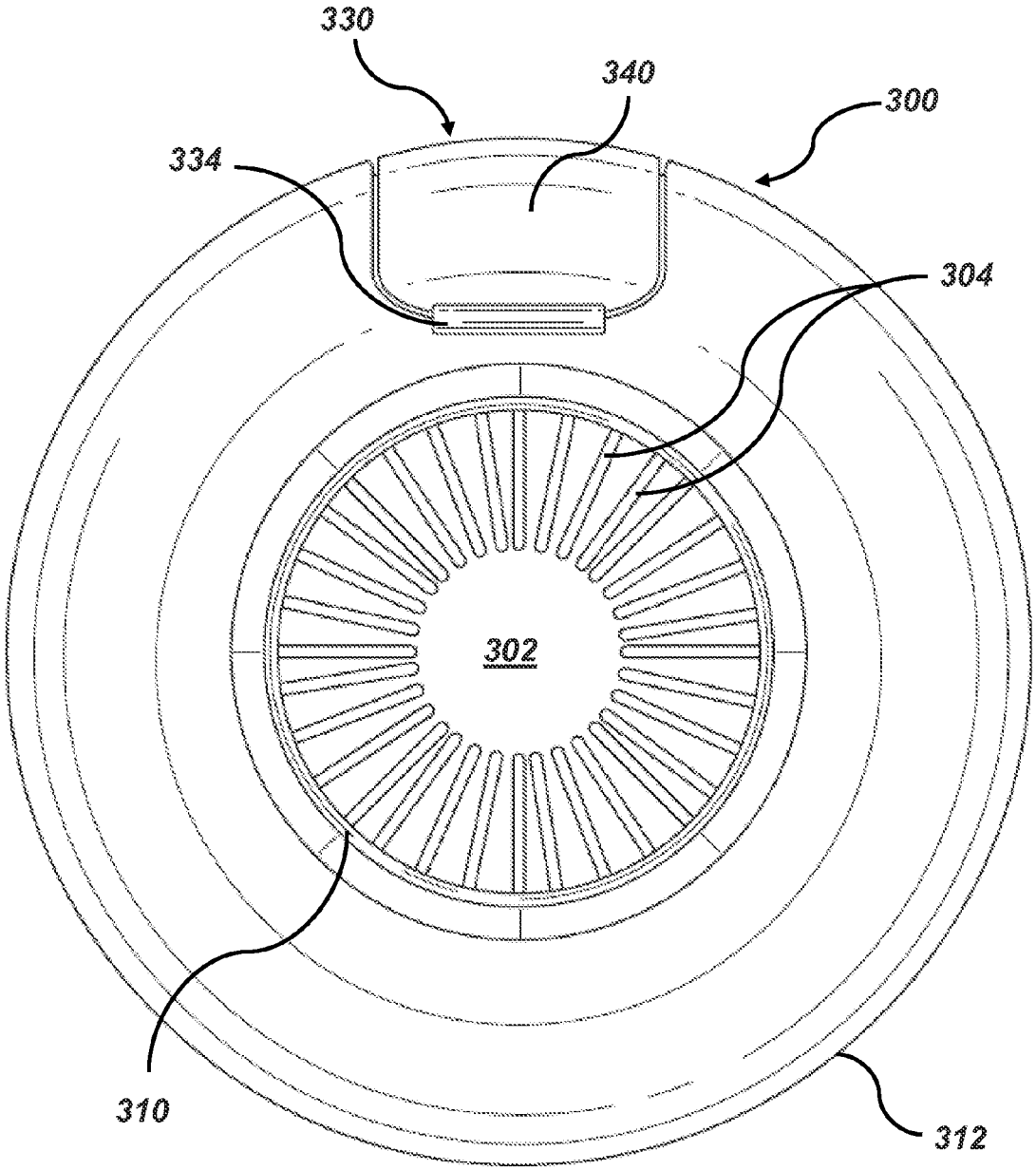
FIG. 9 is a rear elevation view of the cleaning device according to the third embodiment.
Figure 10:
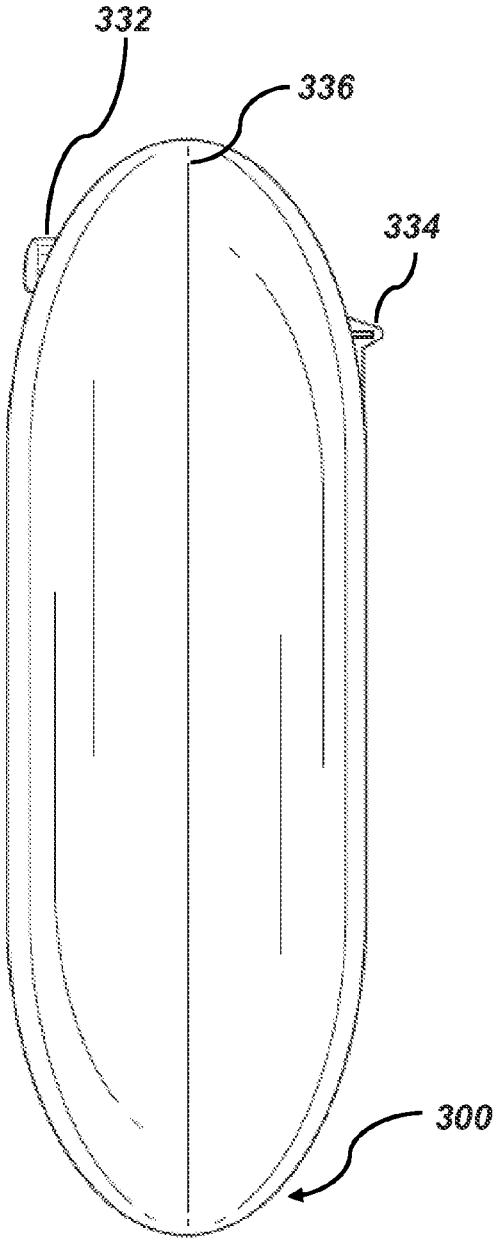
FIG. 10 is a right side elevation view of the cleaning device according to the third embodiment.
Figure 11:
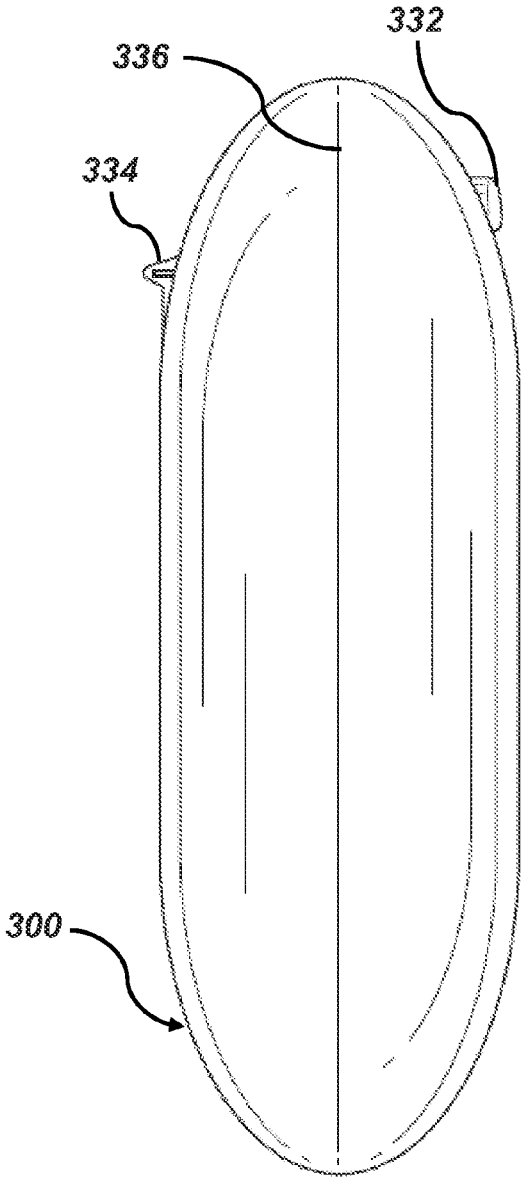
FIG. 11 is a left side elevation view of the cleaning device according to the third embodiment.
Figure 12:
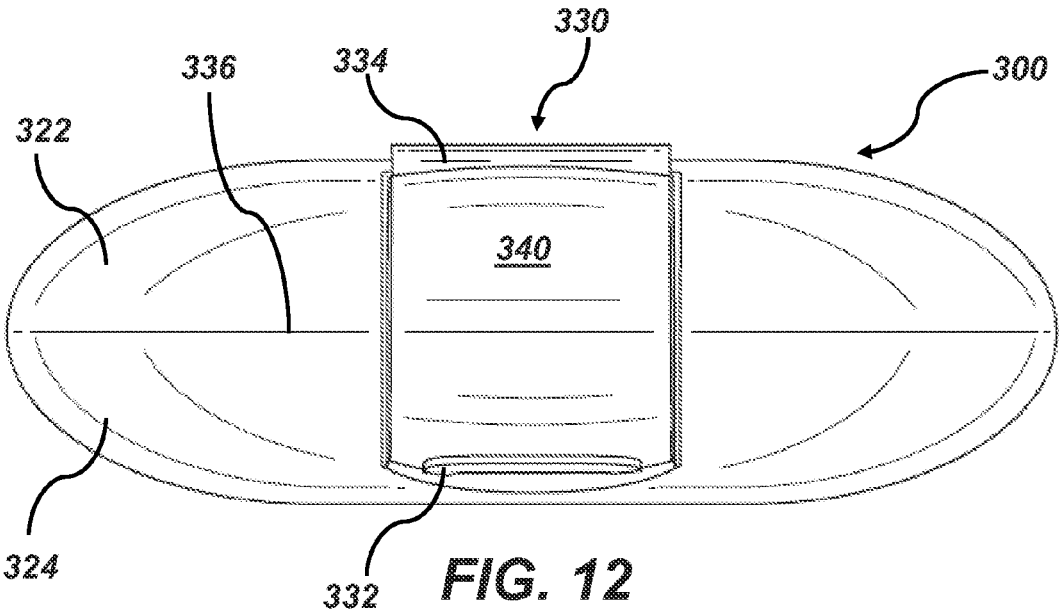
FIG. 12 is a top plan view of the cleaning device according to the third embodiment.
Figure 13:
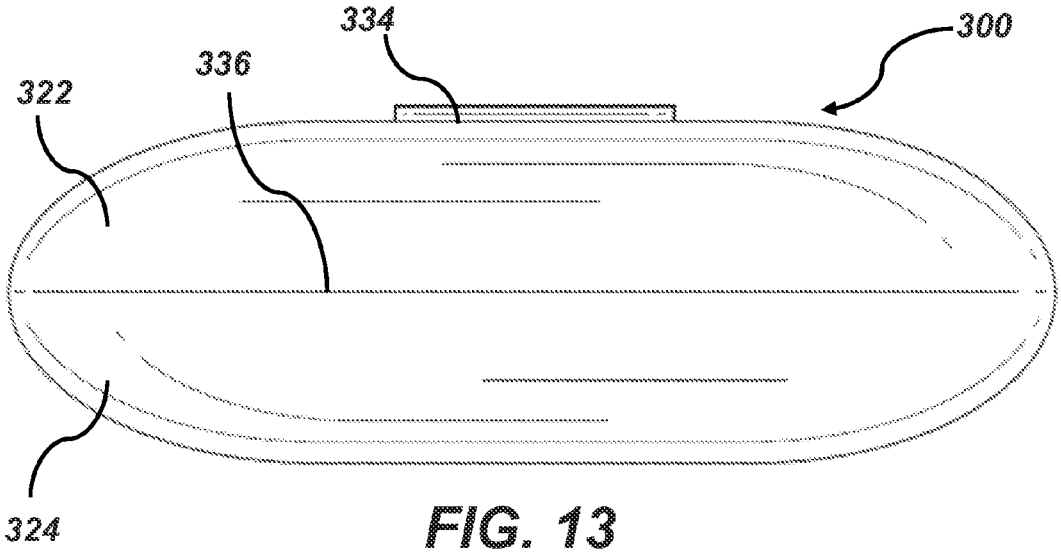
FIG. 13 is a bottom plan view of the cleaning device according to the third embodiment.

FIG. 7 depicts a cleaning device 300 according to a third embodiment. The device 300 includes an inner perimeter 310 that defines an opening 302 located in the center of the device 300. The device 300 may be substantially hollow for storage of fluid. A plurality of protrusions 304 extend from the inner perimeter 310 of the device 300 toward the center of the opening 302. The plurality of protrusions 304 may be bristles. Each of the plurality of protrusions 304 has a first end and a second end, where one of the ends is affixed to or extends from the inner perimeter 310 of the device and one of the ends extends toward and terminates near the center of the opening 302. The plurality of protrusions 304 may be evenly spaced along the inner perimeter 310 of the device 10. The plurality of protrusions 304 may be formed in several rows, effectively forming several circles of protrusions 304. A fluid reservoir (not shown) may be located inside the device 300.

In some embodiments, the plurality of protrusions 304 are located on a bristle ring that can be inserted as a single piece into the inner perimeter 310 of the device 300 during assembly. The bristle ring comprises a ring and the plurality of protrusions 304. In some embodiments, the bristle ring can be easily removed and replaced. This may be beneficial where the plurality of protrusions 304 become too dirty to clean or the protrusions 304 become worn and ineffective for scrubbing. The replaceable bristle ring also allows a user to replace only the bristle ring without having to buy a completely new device 300 when the plurality of protrusions 304 are dirty or require replacement. The bristle ring may comprise a rubber material that can be pinched into place in the inner perimeter 310 of the device 300. During manufacture, the bristle ring may be molded inside out with the plurality of bristles 304 facing outward. During assembly, the bristle ring may be turned inside out and inserted into the device body 300.

The device 300 includes a closure assembly 330, which may, for example, comprise a snap-fit cap. The closure 330 may comprise a lid 340, a lip 332, and a hinge 334. In some embodiments, the closure 330 is formed as a separate piece from rest of the device 300. The lip 332 is located on one end of the lid 340 and comprises an edge that assists a user in opening the snap-fit cap arrangement of the closure 330. The lid 340 pivots open and closed on the hinge 334. In a preferred embodiment, the lid 332 can pivot on the hinge at least 180 degrees without interference. The closure 330 may further comprise a sealing rim (not shown) to prevent fluid leakage.

In some embodiments, closure 330 may comprise a cap that screws off the device 330. In this way, the device 300 acts like a bottle that holds fluid in a fluid reservoir contained in the interior of the device 300. The device 300 may be refillable by opening the closure 330 and pouring fluid into the fluid reservoir through an opening that is otherwise covered by the closure 330.

In some embodiments, the fluid reservoir may comprise a pack of fluid, such as a container or pack filled with fluid. In some embodiments, the device 300 may comprise two halves 322, 324 that connect along an outer perimeter 336 of device 320. The device 300 may be disassembled by separating the two halves 322, 324 (e.g., by unscrewing the two halves from one other, by pushing a button that separates the two halves from each other). When the device 300 is disassembled, an empty fluid pack may be removed and replaced with a new, full fluid pack. The fluid packs may be flexible and made from plastic. The fluid packs may be formed as rings to fit into the donut-shaped device 300 with an outlet. In some embodiments, the fluid reservoir comprises the entire interior of the device 300. As noted above, an empty fluid pack may be fully replaced or refilled by opening the closure 330 and refilling the pack.

In use, the outlet of the fluid pack is configured to be in fluid communication with the outlet of the device 300 such that when the closure 330 is open, fluid from the fluid pack can be poured out of the container, and when the closure 330 is closed, fluid from the fluid pack remains in the device 300 without leakage or spilling. In other embodiments, the fluid pack may comprise other shapes. For example, the fluid pack may be flexible and formed in a long, tube-like shape. Preferably, the length of the fluid pack is slightly less than the circumference of the middle of the device 300 so that the fluid pack can fit completely within the device 300. This fluid pack can then be placed in device 300 when the two halves 322, 324 are separated by slightly bending the fluid pack into a ring shape into one half of the device 322 and then reassembling the device 300 by connecting the one half 322 with the other half 324 of the device 300.

Ideally, the cleaning device is sized to be small enough to be portable and easily stored, for example, in a pocket or a purse. Because the fluid is contained within a fluid reservoir in the device and requires user action to release the fluid (e.g., by pressing a button or by removing or opening a cover), the device can be stored in a pocket or purse without concerns that the fluid will spill or leak.

The cleaning device may be made from polyethylene or polyurethane material. The fluid in the fluid reservoir may comprise any number of cleaning fluids. For example, the fluid may include hand soap, hand sanitizer, or an antiseptic. The fluid may comprise active ingredients such as isopropanol, ethanol, n-propanol, benzalkonium chloride, triclosan, or povidone-iodine. In a preferred embodiment, the fluid is in gel-form.

The protrusions, or bristles, shown in the first, second, and third embodiments of FIGS. 1, 4, and 7, respectively, may comprise a number of natural or synthetic materials. In some embodiments, natural bristles may comprise animal hair bristles. However, animal hair bristles may not be ideal because animal bristles retain bacteria and do not dry as well as their synthetic counterparts. In some embodiments, the bristles comprise synthetic fibers, such as nylon. In one embodiment, synthetic bristles may comprise a polyethylene terephthalate resin or a polybutylene terephthalate resin.

The protrusions 104 in the first embodiment of the device 100 may comprise a flexible rubber material. The rubber material is beneficial because the protrusions 104 can bend and move around the cylindrical object being cleaned (e.g., a person's finger) and effectively scrub the object without damaging the protrusions 104 or the object being cleaned. Similarly, the ribbing 106 can move across the object to remove unwanted materials without causing damage to the device 106 or the object.

Figure 5:
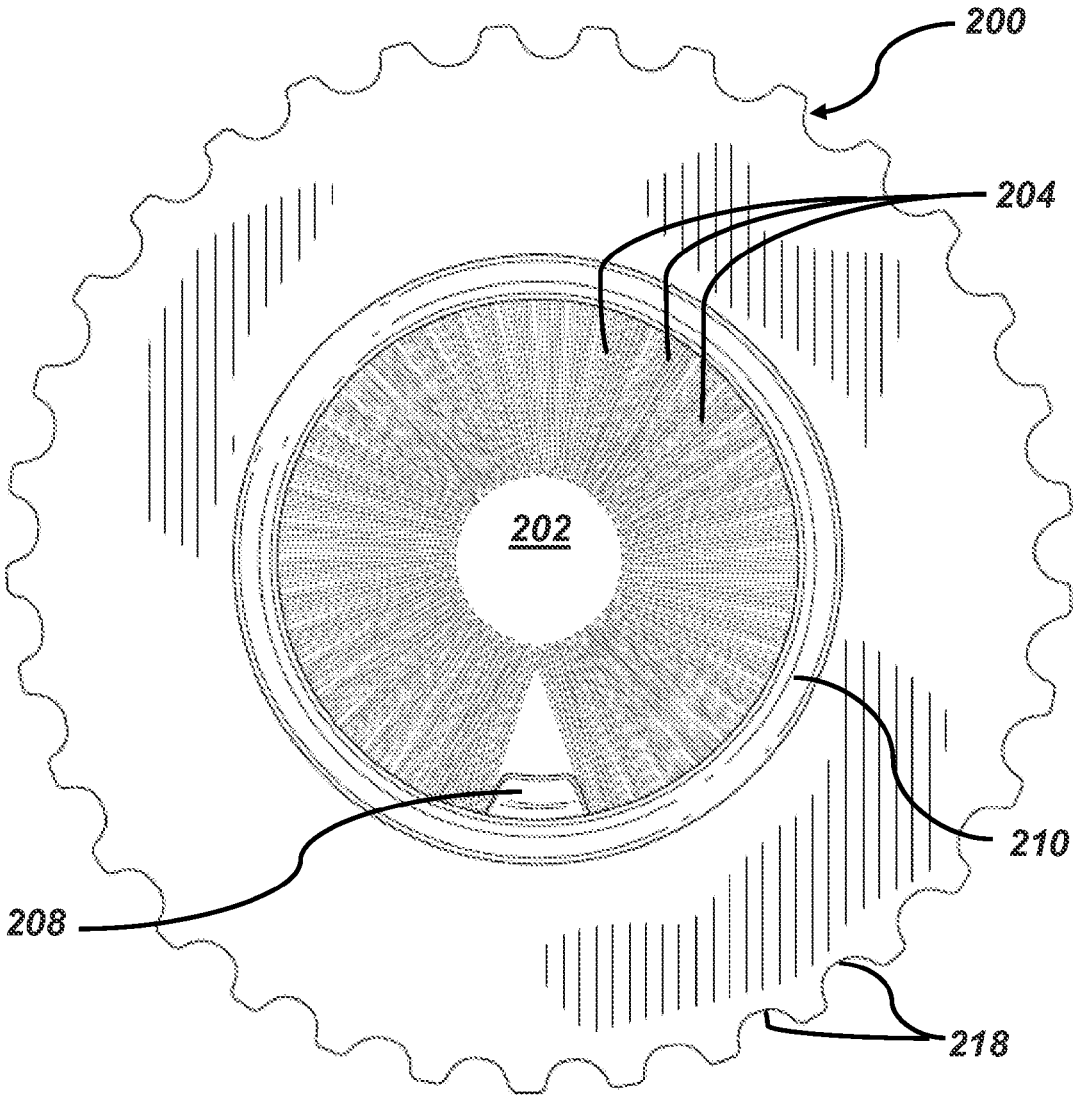
FIG. 5 is a front (and rear) elevation view of the cleaning device according to the second embodiment.
Figure 6:
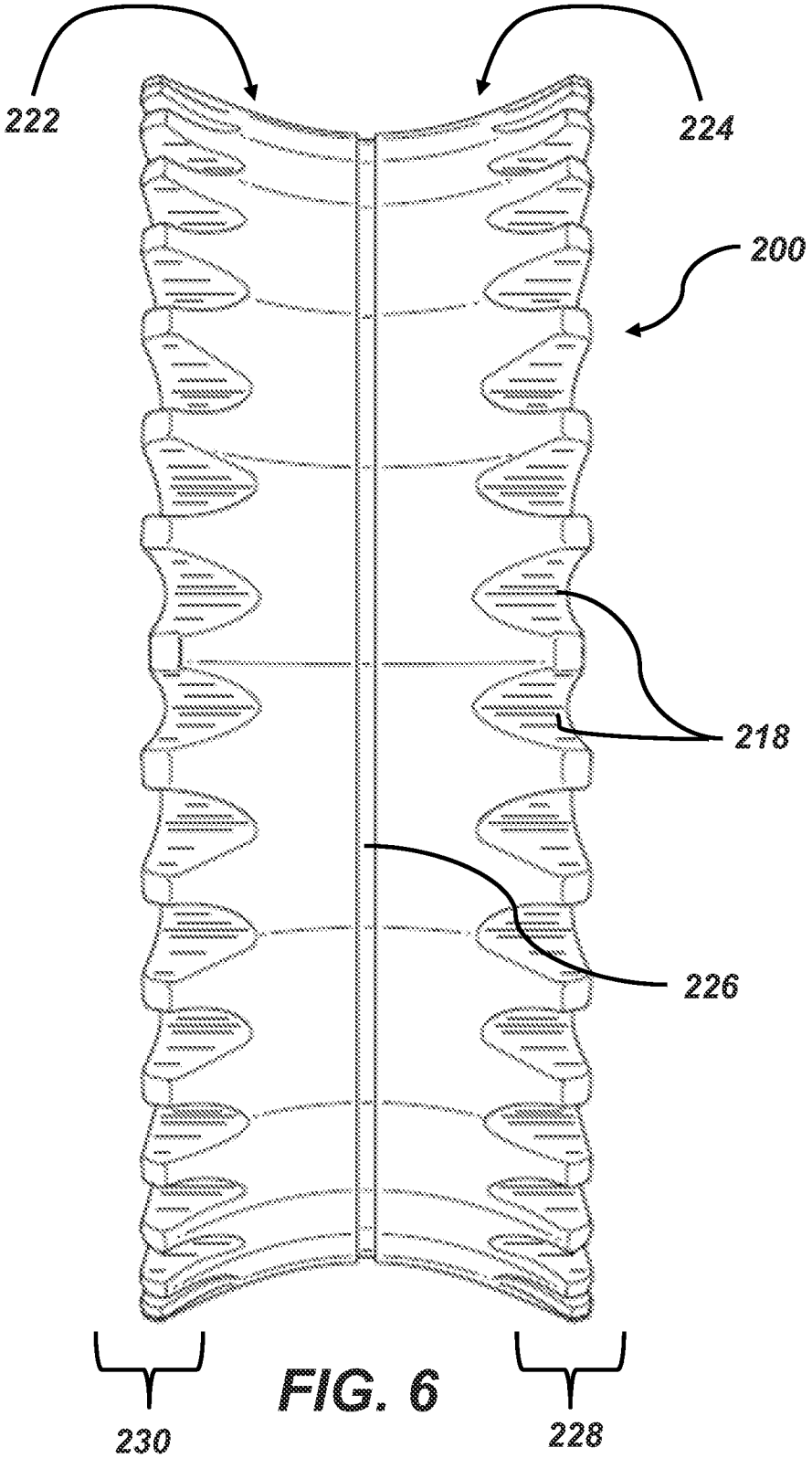
FIG. 6 is a side elevation view of the cleaning device according to the second embodiment.

In embodiments where the protrusions comprise nylon, the protrusions may be similar to the bristles used in toothbrushes. In the second embodiment, shown in FIGS. 4 and 5, the protrusions 204 may comprise a nylon material where the protrusions are spaced closely together. In such a device 200, the protrusions 204 are concentrated more closely than, for example, the protrusions 104, 304 in the first embodiment (FIG. 1) and the third embodiment (FIG. 7). Because the bristles 204 are used to scrub the fingers, it may be preferred to use a softer nylon material to avoid causing scrapes, cuts, or tears in the objects being cleaned by the device 200.

In the third embodiment of the device 300, the protrusions 304 may be formed having a narrow diameter than the protrusions 104 of the first embodiment but a wider diameter than the protrusions 204 of second embodiment. In some embodiments, the protrusions, or bristles, 304 may comprise a flexible rubber material responsive to the force of an object moving through the opening 302. While comprising a flexible rubber material, the bristles 304 would still be stiff enough to effectively scrape the exterior of the object being cleaned (e.g., a person's finger).

While this specification describes the cleaning device with respect to cleaning a person's fingers, it may be used for other purposes. For example, it may be used to clean generally cylindrically-shaped objects, such as tools, battery posts, tubes, pipes, and the like. Furthermore, while the cleaning is generally described as being used for cleaning a person's fingers, it may be formed in different sizes to accommodate people with different hand or finger sizes (e.g., children and adults). Alternatively, if the cleaning device is used to clean, for example, tools, there may be a variety of sizes available to "fit" differently-sized tools. Furthermore, the cleaning device may be a variety of different colors. In some embodiments, the color of the device may coincide with the type of fluid contained in the fluid reservoir. For example, a red device may contain a cherry-scented fluid, while a purple device may include a lavender-scented fluid. Alternatively, the devices may be presented in different colors to coincide with devices with differently-sized openings. The differently-sized openings would be designed for cleaning objects having different diameters. The color coding assists users in selecting the correctly-sized device for a particular cleaning task.

While this specification contains many specific implementation details, these should not be construed as limitations on the scope of the claims, but rather as descriptions of features specific to particular implementations of particular embodiments. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Thus, particular implementations of the subject matter have been described. Other implementations are within the scope of the following claims.

What is claimed is:

1. A body defining a centrally-located opening, comprising:

a fluid reservoir disposed within a perimeter of the body;

an outlet in fluid communication with the fluid reservoir;

a plurality of flexible elements disposed about the perimeter of the opening and projecting inwardly; and a compressible member in fluid communication with the fluid reservoir and the outlet.

2. The body of claim 1, wherein the compressible member can be compressed to release a portion of fluid located in the fluid reservoir.

3. The body of claim 2, wherein the fluid is released by way of the outlet.

4. The body of claim 2, wherein the fluid is directed to one or more of the plurality of flexible elements.

5. The body of claim 2, wherein the plurality of flexible elements are disposed around an entirety of the perimeter of the opening.

6. The body of claim 1, wherein the plurality of flexible elements are disposed around only a portion of the perimeter of the opening.

7. The body of claim 1, wherein a plurality of corrugated protrusions are located along at least a portion of the plurality of flexible elements.

8. The body of claim 1, wherein an entirety of an interior of the body comprises the fluid reservoir.

9. The body of claim 1, wherein the body comprises a plurality of sections releasably coupled together.

10. The body of claim 9, wherein the plurality of sections are releasably coupled together using one of a snap fit arrangement and a threaded arrangement.

11. The body of claim 1, wherein the body comprises an outer perimeter and an inner perimeter that defines the opening, wherein the outer perimeter comprises a plurality of protrusions.

12. The body of claim 1, wherein the body is substantially donut-shaped.

13. A disk-shaped body comprising:

an outer perimeter;

an inner perimeter defining an opening;

a fluid reservoir disposed within the disk-shaped body;

an outlet in fluid communication with the fluid reservoir;

a plurality of flexible elements extending from the inner perimeter, each of the plurality of flexible elements having a first end and a second end; and a compressible member in fluid communication with the fluid reservoir and the outlet.

14. The disk-shaped body of claim 13, wherein the compressible member can be compressed to release a portion of fluid located in the fluid reservoir.

15. The disk-shaped body of claim 13, comprising:

a compressible member disposed on the inner perimeter of the disk-shaped body in fluid communication with the fluid reservoir and the outlet, wherein the compressible member can be compressed to release a portion of fluid located in the fluid reservoir, wherein the outlet is disposed on the inner perimeter of the disk-shaped body that defines the opening.

16. A disk-shaped body comprising:

an outer perimeter;

an inner perimeter defining an opening;

a fluid reservoir disposed within the disk-shaped body;

an outlet in fluid communication with the fluid reservoir; and a plurality of flexible elements extending from the inner perimeter, each of the plurality of flexible elements having a first end and a second end, wherein the outlet is located on the outer perimeter of the disk-shaped body, and the disk-shaped body comprising a closure for opening and closing the outlet.

17. The disk-shaped body of claim 16, wherein the closure comprises a snap-fit cap.

18. The disk-shaped body of claim 16, wherein the plurality of flexible elements are disposed around an entirety of the perimeter of the opening.

* * * * *